US010762766B2

(12) United States Patent
Laurans et al.

(10) Patent No.: US 10,762,766 B2
(45) Date of Patent: Sep. 1, 2020

(54) ALARM SYSTEM WITH DOOR LOCK

(71) Applicant: SimpliSafe, Inc., Boston, MA (US)

(72) Inventors: Charles Laurans, Brookline, MA (US); Heath Marvin, Woburn, MA (US); Rahul Subramany, Boston, MA (US)

(73) Assignee: SimpliSafe, Inc., Boston, MA (US)

( * ) Notice: Subject to any disclaimer, the term of this patent is extended or adjusted under 35 U.S.C. 154(b) by 0 days.

(21) Appl. No.: 16/264,954

(22) Filed: Feb. 1, 2019

(65) Prior Publication Data

US 2020/0250959 A1 Aug. 6, 2020

(51) Int. Cl.

| | |
|---|---|
| ***G08B 25/00*** | (2006.01) |
| ***G08B 25/12*** | (2006.01) |
| ***E05B 45/06*** | (2006.01) |
| ***G07C 9/33*** | (2020.01) |
| ***G07C 9/38*** | (2020.01) |

(52) U.S. Cl.

CPC ..... *G08B 25/008* (2013.01); *E05B 45/06* (2013.01); *G07C 9/33* (2020.01); *G07C 9/38* (2020.01); *G08B 25/12* (2013.01); *E05B 2045/069* (2013.01); *E05B 2045/0695* (2013.01)

(58) Field of Classification Search

CPC ..... G08B 25/008; G08B 25/12; E05B 45/06; E05B 2045/069; E05B 2045/0695; G07C 9/00142; G07C 9/00166

See application file for complete search history.

(56) References Cited

U.S. PATENT DOCUMENTS

| | | | | |
|---|---|---|---|---|
| 5,552,766 | A * | 9/1996 | Lee | E05G 5/003 340/541 |
| 6,225,903 | B1 | 5/2001 | Soloway et al. | |
| 7,391,319 | B1 | 6/2008 | Walker | |
| 7,872,577 | B2 | 1/2011 | Frolov | |
| 8,291,733 | B2 | 10/2012 | Chiou et al. | |
| 9,077,716 | B2 | 7/2015 | Myers et al. | |
| 9,262,879 | B2 | 2/2016 | Ahearn et al. | |
| 9,322,194 | B2 | 4/2016 | Cheng et al. | |
| 9,359,794 | B2 | 6/2016 | Cheng | |
| 9,534,420 | B1 | 1/2017 | Cheng et al. | |
| 9,690,272 | B2 | 6/2017 | Chin et al. | |

(Continued)

FOREIGN PATENT DOCUMENTS

| | | |
|---|---|---|
| EP | 0 315 766 A2 | 5/1989 |
| WO | WO 2017/046399 A1 | 3/2017 |

OTHER PUBLICATIONS

International Search Report and Written Opinion for International Application No. PCT/US2020/015533, dated Jun. 26, 2020.

*Primary Examiner* — Rufus C Point

(74) *Attorney, Agent, or Firm* — Wolf, Greenfield & Sacks, P.C.

(57) ABSTRACT

A building alarm system and automated door lock arranged to place the alarm system in an armed state when a door lock fails to engage to lock an associated door in a closed position. Activation of a single button by a user or use of specific code by a user to gain access to a building can cause the alarm system to automatically rearm and for door locks at the building to be locked after entry by the user. A first responder code can be used by first responder personnel to gain access to a building after an alarm system indicates an alarm state, e.g., that corresponds to an emergency condition.

29 Claims, 1 Drawing Sheet

(56) References Cited

U.S. PATENT DOCUMENTS

| | | | | |
|---|---|---|---|---|
| 9,754,432 | B2 * | 9/2017 | Bender | G07C 9/00309 |
| 9,892,579 | B2 | 2/2018 | Ku | |
| 9,922,481 | B2 | 3/2018 | Johnson et al. | |
| 2005/0030178 | A1 | 2/2005 | Meijer | |
| 2006/0230434 | A1 * | 10/2006 | Sunagawa | G08B 25/01 726/3 |
| 2007/0247302 | A1 * | 10/2007 | Martin | G08B 25/008 340/506 |
| 2009/0261973 | A1 * | 10/2009 | Eakle, Jr. | E05B 41/00 340/540 |
| 2010/0026487 | A1 | 2/2010 | Hershkovitz | |
| 2010/0289644 | A1 * | 11/2010 | Slavin | G08B 21/18 340/568.1 |
| 2013/0300564 | A1 * | 11/2013 | Lamb | G08B 25/008 340/573.4 |
| 2015/0159401 | A1 * | 6/2015 | Patrick | G10L 17/22 292/137 |
| 2015/0308178 | A1 * | 10/2015 | Warren | E05F 3/20 700/275 |
| 2016/0189496 | A1 * | 6/2016 | Modi | G08B 13/08 340/545.2 |
| 2016/0341537 | A1 | 11/2016 | Ku | |
| 2016/0362913 | A1 * | 12/2016 | Yurasits | E05B 45/06 |
| 2017/0002586 | A1 | 1/2017 | Lee | |
| 2017/0037937 | A1 | 2/2017 | Ku | |
| 2017/0068419 | A1 * | 3/2017 | Sundermeyer | G08B 25/008 |
| 2017/0161975 | A1 | 6/2017 | Peng et al. | |
| 2017/0254115 | A1 | 9/2017 | Sotes Delgado | |
| 2017/0337507 | A1 * | 11/2017 | Curry | G07C 9/00182 |
| 2018/0075720 | A1 | 3/2018 | Davies et al. | |
| 2018/0102044 | A1 * | 4/2018 | Lamb | G08B 29/04 |
| 2019/0244511 | A1 * | 8/2019 | Krishnamoorthy | G08B 29/185 |

* cited by examiner

ALARM SYSTEM WITH DOOR LOCK

BACKGROUND

1. Field of Invention

This invention relates to building alarm systems and door locks for automating door lock functions.

2. Related Art

Electronic door lock actuators, including so-called smart locks that are used to actuate existing door lock mechanisms, are known, e.g., as described in US Patent Application Publication US20170037937. Such door lock arrangements can allow a user to both operate the door lock manually, e.g., by operating a thumb turn, and electronically, e.g., by interacting with the door lock via an electronic device such as a smartphone. Alarm systems are also known in the art, e.g., for monitoring a building with respect to various conditions such as unauthorized entry through doors and/or windows, fire or smoke conditions, movement in a room or around a building, etc.

SUMMARY OF INVENTION

Some aspects of the invention allow an alarm system to enter an armed state in response to an automated door lock failing to engage to lock a door. For example, a user may command an automated door lock to engage to lock a door, but the door lock may fail to engage for various reasons, such as the door is not fully closed, the door lock does not have sufficient power to move a lock mechanism, etc. In response to such a condition, an alarm system may be armed to indicate an alarm state in response to various conditions, such as opening of the unlocked door. Thus, a user and/or authorities may at least be notified if an unlocked door—that the user intended to lock—is opened and/or if other alarm conditions are detected at a building.

In one aspect of the invention, a method for controlling an alarm system includes detecting that a door of a building is in a closed position, receiving a signal that a lock associated with the door is to be engaged so as to lock the door in the closed position, receiving a signal indicating that the lock cannot be engaged to lock the door in the closed position, and in response to receiving the signal indicating that the lock cannot be engaged, arming the alarm system to indicate an alarm state upon detection of movement of the door from the closed position to an open position. Detection that the door is in the closed position may include using a door sensor to detect that the door is in the closed position, e.g., a door sensor that is separate from the lock associated with the door, or that is part of the door lock. Reception of a signal that a lock associated with the door is to be engaged may include receiving, e.g., at the door lock, a signal from a user device instructing the lock to move to an engaged position so as to lock the door in the closed position. Such a signal may be provided via a lock server or other device that communicates with the user device and relays suitable commands to the door lock. Thus, the lock may be an automated lock system arranged to be engaged and disengaged with respect to the associated door based on signals provided from a remote user device. Reception of a signal indicating that the lock cannot be engaged may include receiving a signal from the lock, e.g., at an alarm base station or other component, indicating that a portion of the lock such as a lock bolt or latch cannot be moved to an engaged position to lock the door in the closed position. For example, the latch or bolt may be mechanically prevented from moving to the engaged position due to a position of the door relative to a frame of the door.

Arming of the alarm system may include putting the alarm system into an away mode in which the alarm system generates an alarm state upon detection of the door moving from the closed position to an open position as well as upon one or more of the following: detection of movement within the building, detection of opening of a window of the building, detection of sound within the building, detection of breakage of glass at the building, detection of fire at the building, detection of people in or around the building, and detection of a low temperature or water at the building. In other embodiments, arming the alarm system may include putting the alarm system into a home mode in which the alarm system generates an alarm state upon detection of the door moving from the closed position to an open position, but does not generate an alarm condition upon detection of movement within the building. In the home mode, the alarm system may be arranged to generate an alarm state upon detection of one or more of the following: detection of opening of a window of the building, detection of breakage of glass at the building, detection of fire in the building, detection of people around the building, and detection of water at the building.

Actions in addition to arming the alarm system in response to door lock failure to engage may be taken. For example, in response to receiving the signal indicating that the lock cannot be engaged, a message may be sent to a user device indicating that the lock cannot be engaged. The message to a user device may include a request for assistance from the user to engage the lock.

In another aspect, an alarm system includes a door sensor arranged to detect and provide a signal representing whether a door of a building is in an open or closed position, and a door lock associated with the door and arranged to engage to lock the door in the closed position. A base station may be arranged to receive signals from the door sensor representing whether the door is in the open or closed position, and arranged to receive a signal from the door lock indicating whether the door lock is engaged to lock the door in the closed position. The base station may be configured and arranged to enter an armed state in response to a signal from the door lock indicating that the door lock is unable to engage to lock the door in the closed position, with the armed state being a state in which the base station indicates an alarm state upon detection by the door sensor of the door moving from the closed position to the open position. The system may include one or more sensors to generate a signal representing one or more of the following: detection of movement within the building, detection of opening of a window of the building, detection of sound within the building, detection of breakage of glass at the building, detection of fire in the building, detection of people in or around the building, and detection of a low temperature or water at the building, and the base station may be arranged, when in an armed state, to indicate an alarm state based on a signal from the one or more sensors.

As discussed above, the base station may be configured and arranged to enter an away mode in response to the signal from the door lock indicating that the door lock is unable to engage, with the away mode being an armed state in which the base station indicates an alarm state upon detection of the door moving from the closed position to an open position as well as upon one or more of the following: detection of movement within the building, detection of opening of a window of the building, detection of sound within the building, detection of breakage of glass at the building, detection of fire in the building, detection of people in or around the building, and detection of a low temperature or water at the building. In some embodiments, the base station may be configured and arranged to enter a home mode in response to the signal from the door lock indicating that the door lock is unable to engage, with the home mode being an armed state in which in which the alarm system indicates an alarm condition upon detection of the door moving from the closed position to an open position, but does not generate an alarm condition upon detection of movement within the building.

In some embodiments, the door sensor is separate from the door lock associated with the door, but may be arranged to be part of the door lock. The door lock may be configured and arranged to receive a signal from a user device instructing the door lock to move to an engaged position so as to lock the door in the closed position, and the door lock may be configured and arranged to move a portion of the door lock to the engaged position in response to the signal from the user device. However, if the door lock cannot engage, the door lock may be configured and arranged to send a signal to the base station indicating that a portion of the lock cannot be moved to the engaged position to lock the door in the closed position. The portion of the lock may be a latch or bolt that is mechanically prevented from moving to the engaged position, e.g., due to a position of the door relative to a frame of the door.

In some embodiments, the base station may be arranged to operate, at least in part, within the building, and may be arranged to communicate with a monitoring server that is remote from the building, e.g., the base station may be arranged to send a signal representing the alarm state to the monitoring server. In some cases, when the base station indicates an alarm state in response to the unlocked door moving from the closed position to the open position, the base station may enter an entry delay mode during which a user can prevent the base station from notifying authorities of the alarm state and/or emitting an alarm sound or other indication. The entry delay mode may be associated with a period of time, and the base station may be configured to notify authorities of the alarm state if the period of time passes and a user does not prevent the base station from notifying authorities.

In one embodiment, an alarm system includes a door sensor arranged to detect and provide a signal representing whether a door of a building is in an open or closed position, and a door lock associated with the door and arranged to engage to lock the door in the closed position. A controller, e.g., as part of a base station or server remote from the building, may be arranged to receive signals from the door sensor representing whether the door is in the open or closed position, and arranged to receive a signal from the door lock indicating whether the door lock is engaged to lock the door in the closed position. The controller may be configured and arranged to enter an armed state in response to a signal from the door lock indicating that the door lock is unable to engage to lock the door in the closed position, with the armed state being a state in which the controller indicates an alarm state upon detection by the door sensor of the door moving from the closed position to the open position.

In another aspect of the invention, an alarm system includes a door lock associated with a door of a building, with the door lock arranged to engage to lock the door in the closed position. A base station may be configured and arranged to enter an armed state, with the armed state being a state in which the base station indicates an alarm state in response to one or more of the following: detection of movement within the building, detection of opening of a window of the building, detection of opening of a door of the building, detection of sound within the building, detection of breakage of glass at the building, detection of fire in the building, detection of people in or around the building, and detection of a low temperature or water at the building. The door lock and the base station may be configured and arranged to respectively engage to lock the associated door and enter the armed state in response to one of activation of a single button by a user and use of a specific code to put the base station in a disarmed state to enter the building.

In some embodiments, the single button may be located on a keypad in communication with the base station, and/or the specific code may be typed into a keypad located exterior to the building. For example, a user may type the specific code into the keypad to disarm the alarm system and enter a building. Thereafter, the alarm system may automatically re-arm itself and door locks engaged to lock associated doors without the user needing to take any additional action. In other embodiments, the base station may send a signal to the door lock to engage to lock the associated door in response to the user activating the single button on the keypad. In addition to responding to signals from the base station, the door lock may be configured and arranged to engage to lock the associated door in response to a signal from a user device, e.g., a user may send a lock signal to the door lock and the signal from the user device may not be received by the base station.

In some embodiments, a door sensor may be arranged to detect and provide a signal to the base station representing whether the door of the building is in an open or closed position. For example, the door sensor may be separate from the door lock and the signal provided by the door sensor to the base station need not be received by the door lock. In some cases, the base station may be configured to indicate an alarm state when the door sensor provides a signal that indicates the door is in an open position while the door lock is engaged to lock the door in the closed position. Such an occurrence may happen when a person forces a door open without disengaging the door lock. In some cases, the system includes a plurality of door locks each associated with a respective door of the building, with each of the plurality of door locks arranged to engage to lock the associated door in the closed position in response to the activation of the single button by the user and/or the use of the specific code to put the base station in the disarmed state. The system may include additional sensors, such as one or more sensors to generate a signal representing one or more of the following: detection of movement within the building, detection of opening of a window of the building, detection of sound within the building, detection of breakage of glass at the building, detection of fire in the building, detection of people in or around the building, and detection of a low temperature or water at the building. The base station may be arranged, when in an armed state, to indicate an alarm state based on a signal from the one or more sensors.

In some embodiments, the base station may be configured and arranged to enter an away mode in response to a signal from the door lock indicating that the door lock is unable to engage to lock the associated door in the closed position, with the away mode being an armed state in which the base station indicates an alarm state upon detection of the door moving from the closed position to an open position as well as upon one or more of the following: detection of movement within the building, detection of opening of a window of the building, detection of sound within the building, detection of breakage of glass at the building, detection of fire in the building, detection of people in or around the building, and detection of a low temperature or water at the building. In other embodiments, the base station may be configured and arranged to enter a home mode in response to a signal from the door lock indicating that the door lock is unable to engage to lock the associated door in the closed position, with the home mode being an armed state in which in which the alarm system indicates an alarm condition upon detection of the door moving from the closed position to an open position, but does not generate an alarm condition upon detection of movement within the building.

The base station may be configured to communicate with a monitoring server or other devices that are remote from the building, with the base station arranged to send a signal representing the alarm state to the monitoring server or other devices, e.g., to notify authorities, a user or other personnel of an alarm condition as well as other sensed conditions at the building.

Other advantages and novel features of the invention will become apparent from the following detailed description of various non-limiting embodiments when considered in conjunction with the accompanying figures and claims.

BRIEF DESCRIPTION OF THE DRAWINGS

Aspects of the invention are described with reference to the following drawings in which numerals reference like elements, and wherein.

DETAILED DESCRIPTION

Aspects of the invention are described below by way of one or more illustrative embodiments. It should be understood that the illustrative embodiments described are not intended to limit the aspects of the invention, but rather to help show how one or more aspects of the invention may be implemented in a particular example. Also, aspects of the invention may be implemented alone and/or in combination with other aspects of the invention. For example, an arrangement is described below in which an alarm system can enter an armed state in response to failure of a door lock to engage to lock an associated door. The system is also described as capable of entering an armed state in response to press of a single button by a user and/or in response to use of a particular access code to gain access to a building. In addition, a door lock may be able to unlock and allow access to first responders in response to a first responder code during fire/smoke, forced entry or medical emergency conditions. These features may be combined into a single system as described, or may be employed separately, e.g., an alarm system which can enter an armed state in response to a door lock's failure to engage need not necessarily be configured to enter an armed state in response to use of a particular access code and/or press of a single button by a user.

Figure 1:
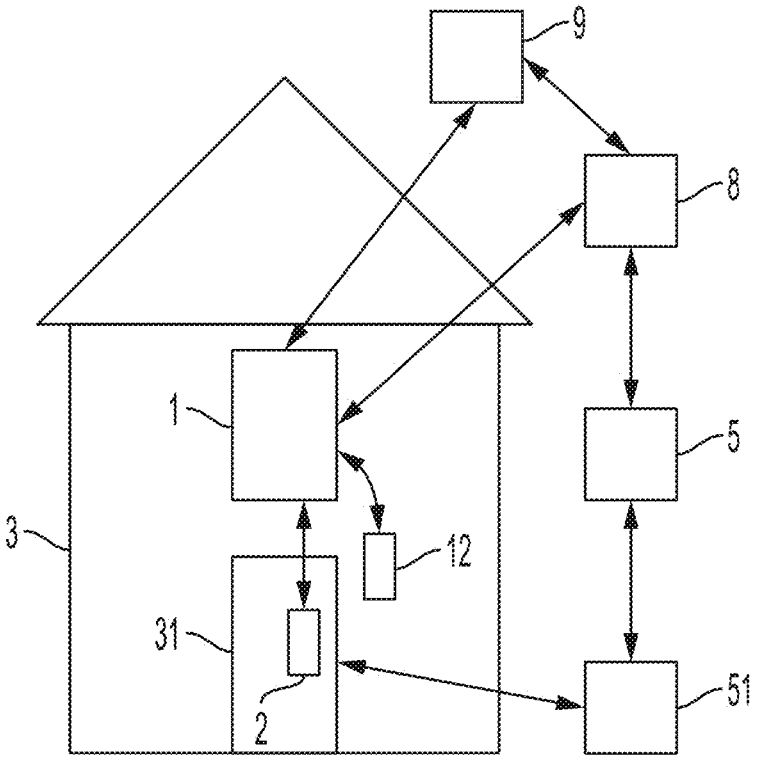
FIG. 1 is a schematic block diagram of components in an alarm system including a door lock in an illustrative configuration.

FIG. 1 shows an illustrative arrangement including an alarm system that incorporates one or more aspects of the invention. In this embodiment, a building 3 includes one or more doors 31 which may be used by persons to enter and/or exit the building 3 or to move between rooms or other spaces in the building 3. As used herein, the term "building" refers to any suitable structure that may be entered and/or exited by a person, such as a single family home, a single apartment in a multi-apartment complex, a warehouse or other industrial facility, one or more rooms or other spaces of a larger structure, and so on. The building 3 is equipped with an alarm system that may be used to monitor the building 3 for various conditions, such as use of doors 31 to enter/exit the building 3, noise at the building 3, fire and/or smoke conditions at the building 3, movement of people or objects at the building 3, abnormally high/low temperatures and/or water at the building 3, etc. (As used herein, conditions "at" a building refers to the condition being within and/or near the building, e.g., movement of persons "at" a building refers to movement of persons within and/or near the building.) As is understood in the art, the alarm system may be employed to monitor conditions at the building as well as taking particular actions in response to sensed conditions, such as notifying authorities (e.g., police, fire, building management, etc.) of particular conditions, notifying a user of particular conditions, displaying an alarm (e.g., emitting siren noises and emergency lighting at the building, etc.), recording video and/or audio conditions at the building, and so on. Thus, although the system is referred to herein as an "alarm" system, the alarm system need not necessarily display alarm sounds or lights at the building, but instead may be employed only for monitoring conditions at the building and optionally reporting on monitored conditions.

In this embodiment, the alarm system includes a base station 1 located at the building 3 which coordinates communications between the building 3 and remote devices and that can communicate with other devices located at the building 3. The base station 1 is shown as a single element, but may include two or more components, which may be located separately at the building 3 and/or remotely from the building 3. Thus, while in this embodiment the base station 1 is located at the building 3, the base station 1 may be located remotely from the building 3 at least in part, e.g., the base station 1 may be implemented at least in part at one or more computers or other data processing devices that are remote from the building 3. While the base station 1 may be configured and arranged to communicate with any number and/or type of remote devices using any suitable communications channel (e.g., wireless, wired, Internet, cellular telephone, satellite, etc.), in this embodiment the base station 1 is arranged to communicate with one or more monitoring servers 8 as well as authorities communication devices 9. The monitoring server(s) 8 may receive information and commands from the base station 1, such as alarm and other conditions sensed at the building 3, and take suitable action including sending information and commands to the base station 1, authorities devices 9, and others. For example, the base station 1 may send to the monitoring server(s) 8 information indicating an alarm condition related to unauthorized entry into the building 3, and in response the monitoring server(s) 8 may notify authorities (e.g., fire, police, etc. via the authorities communication devices 9) of the alarm condition along with other information such as the suspected point of entry into the building 3, etc. The monitoring server(s) 8 may also notify a user of sensed conditions by communicating with a user device 5, such as a smartphone, computer or other communication device. As with other communications in the alarm system, the monitoring server(s) 8 may communicate with other devices via any suitable communications network or other channel, such as wired or wireless networks, Internet, cellular telephone, satellite, etc. The monitoring server(s) 8 may provide other functions as are known in the art. For example, the monitoring server(s) 8 may relay video and/or audio information received from a camera at the building 3 to the user device 5, which may display the video and/or audio information to the user. This may, for example, allow the user to observe and communicate with a visitor at the building 3 who is seeking entry to the building 3. The user 5 may also provide commands to the monitoring server(s) 8, such as instructions to cancel an alarm state at the building 3, and the monitoring sever(s) 8 may provide suitable commands to the base station 1 accordingly. Although in this embodiment the user device 5 communicates with the base station 1 and other devices at the building 3 (such as cameras, microphones, etc.) via the monitoring server(s) 8, the user device 5 may communicate more directly with the base station 1 and/or other devices at the building 3. As an example, the user device 5 may communicate directly with an audio/video recording and display device (e.g., a camera, speaker and microphone that is part of a doorbell at the building 3) to receive audio/video data recorded from the building 3, as well as provide audio/video data for display at the building 3. Similarly, the base station 1 may communicate more directly with authorities devices 9 and/or other devices rather than via the monitoring server(s) 8. This may, for example, allow the base station 1 to relay alarm state messages to the authorities devices 9 even if communication with the monitoring server(s) 8 is interrupted.

In this embodiment, the building 3 is equipped with one or more door locks 2 that are arranged to engage to lock an associated door 31 in a closed position, and to disengage to unlock the door 31. The door lock 2 may be configured to receive commands or other information, such as a command to move a bolt, latch or other mechanism to lock or unlock the associated door 31 in a closed position. In this embodiment, the door lock 2 may communicate with a lock server 51 to send and receive commands and other information. The lock server 51 may manage operation of the door lock 2 as well as communications with the user device 5 via which the user may provide instructions for lock operation and/or receive information from the door lock 2, such as whether the door lock 2 is engaged to lock a door 31 or not. While in some embodiments the functions of the lock server 51 may be performed by the monitoring server(s) 8, in this embodiment the door lock 2 is capable of operating and being operated independently of the alarm system although the door lock 2 can coordinate at least some of its functions with the base station 1 as described more below. Thus, a user, e.g., interacting with an application running on the user device 5, may provide instructions to the lock server 5 to lock or unlock the door 31 and/or receive information regarding door lock 2 status and other conditions, and the lock server 51 may provide suitable information or commands to the door lock 2. The door lock 2 may communicate with the base station 1, either directly via a local network (e.g., Wi-Fi) or other communications channel, or more indirectly via the lock server 51 which may communicate with the monitoring server(s) 8 via the Internet or any other suitable communications network(s) or channels. Thus, the base station 1 may receive information from the door lock 2, such as whether the door lock 2 is engaged or not to lock the door 31 in a closed position. As noted above, the alarm system may include sensors to detect various conditions at the building 3, and FIG. 1 shows one such sensor, i.e., a door sensor 12 that can detect whether the door 31 is in an open or closed position. The door sensor 12 may be part of the door lock 2, or may be independent of the door lock 2, e.g., part of the alarm system such that the door sensor 12 communicates to the base station 1 whether an associated door is open or closed. Therefore, the base station 1 may receive information regarding whether the door 31 is in an open or closed position as well as whether the door lock 2 is engaged or not to lock the door 31 in a closed position.

In accordance with an aspect of the invention, the base station may be configured and arranged to enter an armed state in response to a signal from the door lock indicating that the door lock is unable to engage to lock the door in the closed position. This may occur, for example, when a user sends a command to the door lock 2, e.g., via the user device 5 and the lock server 51, to engage to lock the door 31 associated with the door lock 2, but the door lock 2 is unable to engage to lock the door. Normally, when the door lock 2 receives a command to engage to lock an associated door 31, the door lock 2 will properly engage. However, in some cases the door lock 2 may not be able to engage to lock the door, e.g., because the door 31 is closed but not positioned properly so that a lock bolt, latch or other mechanism can move to lock the door 31. This can occur with almost any type of door, but potentially more often with older doors which can be closed but still not properly positioned to allow a door lock mechanism to engage. In some embodiments, the door lock 2 may request assistance from the user to properly position the door 31 so the lock 2 can engage or otherwise notify the user of the failure to engage, e.g., by sending a message to the user device 5. In other cases, for example, the door lock 2 may have insufficient electrical power to engage a bolt, latch or other lock mechanism, or there may be other causes for why the door lock 2 cannot properly engage to lock an associated door. In such cases, the user may believe the door was locked even though the door lock 2 could never properly engage. By having the base station 1 enter an armed state when a door 31 is closed but a door lock 2 fails to engage as commanded, the base station 1 can monitor movement of the door 31 and indicate an alarm state if the door 31 moves from the closed to the open position. In this way, opening of the unlocked door 31 can cause the alarm system to enter an alarm state in which an alarm condition may be signaled, e.g., by sounding a siren, notifying authorities, notifying a user, etc.

The armed state that the base station 1 enters in response to a signal indicating that a door lock cannot engage to lock a door may be configured in a variety of different ways. In one embodiment, the armed state is one in which the base station indicates an alarm state upon detection by a door sensor of the door (which could not be locked by the door lock) moving from the closed position to the open position. The alarm state of the base station can cause different actions or combinations of actions to occur. For example, the base station 1 may send a signal to the monitoring server(s) 8 that the door 31 has been opened, and in response the monitoring server(s) 8 may notify the user device 51 of the opened door 31, notify authorities via the authorities devices 9, etc. The base station 1 alternately or in addition may indicate an audible or visual alarm at the building 3, may activate an automatic door closer which urges the door toward a closed position, may display an audible request to close the opened door 31, may begin recording video and/or audio information from an area around the opened door 31, etc. The base station 1 may receive information regarding movement of the door 31 from the closed position to an open position in different ways, such as by a signal from a door sensor 12, from the door lock 2, by detecting movement of the door 31 via a movement sensor in a room of the building near the door 31, etc.

The armed state into which the base station 1 enters in response to failure of a door lock to engage to lock a door may also be arranged to cause the base station to indicate an alarm state in response to other sensed conditions in addition to movement of the unlocked door from the closed to the open position. For example, the armed state may be an "away" mode in which the base station generates an alarm state upon detection of the unlocked door moving from the closed position to an open position as well as upon one or more of the following: detection of movement within the building, detection of opening of a window of the building, detection of sound within the building, detection of breakage of glass at the building, detection of smoke and/or fire at the building, detection of people in or around the building, and detection of a low temperature or water at the building, and others. Thus, even if a user intended to only lock the door 31 but did not intend to arm the alarm system, if the door lock 2 fails to engage to lock the door 31, the alarm system may enter into an armed state that indicates an alarm state in response to a variety of different conditions in addition to opening of the unlocked door.

While an "away" mode may be effective if the door is to be locked when no people are in the building or intended to be in the building, the "away" mode may not be suitable for all situations. For example, if a user attempts to lock the door using the door lock 2 while a person is in the building, an "away" mode or other alarm mode that indicates an alarm state in response to movement within the building or other activity normally engaged in by authorized persons in the building may cause a false alarm. Therefore, in some embodiments, the base station may enter into a "home" mode in response to failure of a door lock to engage to lock a door. In one embodiment, the "home" mode may be one in which the alarm system generates an alarm state upon detection of the door moving from the closed position to an open position, but does not generate an alarm condition upon detection of movement within the building or other normal conditions when an authorized person is in the building, such as opening and closing of interior doors, opening a window, etc. This may help reduce the occurrence of false alarms. The "home" mode may still indicate an alarm condition for other sensed conditions, e.g., conditions that relate to safety of individuals at the building, such as smoke or fire at the building, low temperatures or water at the building, etc.

In some cases, a user may select to have the alarm system enter an away mode or home mode in response to failure of a door lock to engage. For example, the base station may initially enter a home mode upon indication that a door lock fails to engage to lock a door. However, if the base station fails to detect movement or other activity in the building indicative of the presence of authorized persons at the building for a time period after the indication of the door lock engagement failure (e.g., 15 seconds to 5 minutes or more), the base station may switch to an away mode. Alternately, the base station may initially enter an away mode upon indication of a door lock's failure to engage to lock a door, and then switch to a home mode if movement or other normal activity is detected within the building within a particular time period.

Figure 2:
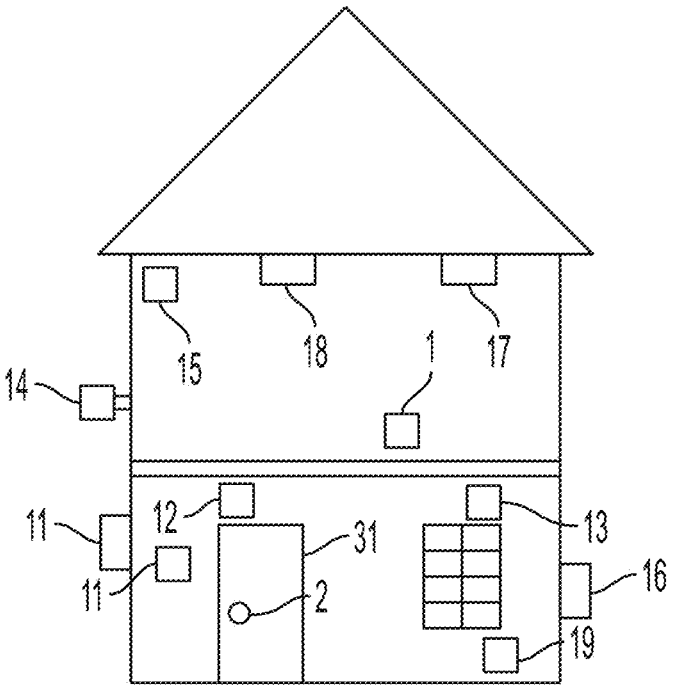
FIG. 2 is a schematic block diagram illustrating various sensors and other components for use with a building alarm system in the FIG. 1 embodiment.

FIG. 2 shows a close up view of the building of FIG. 1 and additional, optional sensors that may be included with the alarm system in some embodiments. Although other arrangements are possible, the alarm system in FIG. 2 includes one or more keypads 11 that a user may employ to provide information to and/or receive information from the base station 1. For example, the keypad 11 may have a number pad or other arrangement to allow a user to enter an alphanumeric string or other code to the base station 1, e.g., to place the base station 1 in an armed or unarmed state, to configure the alarm system in one or more ways, to silence or initiate an alarm state, to communicate with the monitoring server(s) 8 and/or authorities devices 9, to provide a code to the door lock 2 to unlock an entry door, etc. As an example, if a user enters the building 3 while the alarm system is in an armed state, the user may employ the keypad 11 to enter an entry code or other information to prevent the alarm system from indicating an alarm state, e.g., in which authorities are notified of an alarm condition. One or more keypads 11 may be provided within or outside of the building 3, as desired. In addition, or alternately, a user may interact with the base station 1 via the user device 5, e.g., a keypad 11 may be implemented via a user interface on the user device 5.

In one aspect of the invention, the alarm system may be arranged to enter an armed state and a door lock engaged to lock an associated door in response to a user pressing a single button, e.g., on a keypad 11, and/or in response to use of a specific code, e.g., to gain access to the building 3. As an example, a user may press a single button on a keypad 11 after entering the building 3 so that the base station 1 enters an armed state (e.g., a home mode) and one or more door locks 2 are engaged to lock their associated doors 31 in a closed position. Where door locks 2 are not fully integrated with the alarm system, the base station 1 may send a signal to the door lock(s) 2 at the building instructing the door lock(s) 2 to engage to lock their associated doors 31 in response to button press on the key pad 11. Such a signal may be sent directly from the base station 1 to the door lock(s) 2, or via the monitoring server(s) 8, lock server 51, and/or other devices via any set of suitable communication channels. Such an arrangement may allow a user to easily and rapidly re-arm an alarm system as well as lock any unlocked doors in a single action.

As another example, a user may enter a particular code into a keypad 11 to gain access to the building 3 (e.g., to place the base station 1 in an unarmed state so doors can be opened without triggering an alarm condition and/or to unlock an entry door) and thereafter the base station 1 may automatically enter an armed state and one or more door locks 2 may automatically engage to lock their respective doors 31. These rearming and lock engagement features may be activated automatically without further action required by the user and may allow for easier and more foolproof arming of an alarm system and locking of doors for particular users. As an example, a child may be associated with a specific code to gain access to a building 3. Thus, the child may use the code, e.g., with a keypad 11, keyfob, or user device 5, to cause the base station 1 to enter an unarmed state and/or to unlock an entry door 31 so the child can enter the building 3 without triggering an alarm condition. Thereafter, the base station 1 may enter an armed state and door locks 2 may engage to lock respective doors 31, e.g., after a period of time has elapsed since the code was used, after a door 31 was opened and closed by the entering child, or other condition that indicates the child has entered the building 3 and the alarm system can be rearmed and doors locked. This may help ensure that an alarm system is armed and doors locked after a child has returned home, thereby avoiding any potential problem that a child may forget to lock doors and rearm the alarm system. Of course, these features may be employed for any user, regardless of the user's age.

As another example, use of a single button by a user whether on a keypad 11, user device 5 or other user interface with the base station 1 or door lock 2 may allow a user to more simply and reliably both arm an alarm system and lock doors of a building 3. This feature may be particularly useful if door locks 2 at the building 3 are not fully integrated with the alarm system. That is, door locks 2 may be provided separately from an alarm system, and may be operated independently of the alarm system. For example, a user may enjoy regular use of remote activated door locks 2 via a user device 5 and the lock server 51, but may use an alarm system less frequently. Thus, a user may interact with the alarm system less than the door lock system, and the door lock system may have a completely separate interface (whether on the user device 5 or other interface) than the alarm system. By providing the user with a single button to activate to both arm an alarm system and lock building doors, the user may be ensured that both functions are employed. As an example, the user interface on the user device 5 for the door lock 2 (or the alarm system) may include a single button (via touch screen or other interface like a keypad 11) that a user can activate to arm the alarm and lock doors. The user may receive feedback from the base station 1 and the door locks 2 that the alarm system is suitably armed and doors locked, all in response to a single action by the user.

As with other embodiments, the armed state into which the base station 1 enters in response to single button activation and/or specific code use may be arranged in different ways. For example, in the armed state, the base station may indicate an alarm state in response to one or more of the following: detection of movement within the building, detection of opening of a window of the building, detection of opening of a door of the building, detection of sound within the building, detection of breakage of glass at the building, detection of fire in the building, detection of people in or around the building, and detection of a high/low temperature or water at the building and others. As noted above, the armed state may be an "away" mode or "home" mode or other configuration for the alarm system in which different sensed conditions cause the base station to indicate an alarm condition. FIG. 2 shows a variety of different sensors that may be employed by the alarm system to detect conditions at the building 3, such as a door sensor 12 to detect whether a door is in an open or closed position, a window sensor 13 to detect whether a window is opened or closed, a camera 14 which may detect visual and/or audible information at the building 3 such as the presence of persons or noise at the building, a motion sensor 15 which can detect motion of persons or objects but not necessarily detect video information, a microphone 16 or other sound detector which can detect noises such as breaking of glass, loud impacts such as hammering, talking by people, etc., a smoke (including carbon monoxide) and/or fire detector 17, a siren 18 to make audible sounds such as to indicate an alarm condition, a temperature and/or water sensor 19 to detect a temperature and/or the presence of water in abnormal locations, and others. The base station 1 may be in communication with all of the sensors at the building, and may be arranged to record sensor information, such as video or other data for later review by a user. Those of skill in the art will appreciate the variety of sensors that may be employed with an alarm system, and how the information detected by the sensors may be used, recorded or otherwise handled for use with the alarm system.

In another aspect of the invention, a door lock may be arranged to disengage to permit movement of an associated door from a closed position to an open position in response to a first responder code received only during a period after the base station indicates an alarm state. For example, the alarm system may indicate an alarm state in response to an emergency condition including detection of smoke (including carbon monoxide) or fire at the building, detection of forced entry into the building, or detection of a medical emergency at the building, and during a period after the alarm system indicates the alarm state indicative of an emergency condition, a door lock may disengage from a locked state to an unlocked state in response to receipt of a first responder code. As a result, the door lock may allow first responder personnel, such as fire or medical personnel, access to the building in case of an emergency condition, such as a fire, forced entry and/or injury to a person in the building. During other times, such as when the alarm system is armed but not indicating an alarm state, a first responder code may not cause the door lock to disengage from a locked state. This may give users of the alarm system, including people who dwell in the building, comfort that no person—including police and fire personnel—can gain access to the building by using a first responder code unless the alarm system is indicating an alarm condition. Also, by having the door lock disengage from a locked to an unlocked state in response to a first responder code, rather than simply in response to the alarm system indicating an alarm state, the building can be secured against unauthorized entry, especially conditions created by a person seeking unauthorized entry. For example, some alarm systems may operate to unlock doors to the building in response to an alarm system indicating an alarm state. However, such a system can be exploited, e.g., by a thief introducing smoke into the building, thereby causing the smoke to be detected by the alarm system and doors to be unlocked in response to the alarm condition. In contrast, having a door lock disengage from a locked to an unlocked state in response to a first responder code avoids such problems.

The first responder code can be provided to cause a door lock to disengage in different ways, including ways that reduce or eliminate any time between first responder arrival at the building and unlocking of a door so personnel can gain entry to the building. For example, first responder personnel may be provided with a key fob, access card or similar device that can communicate a first responder code to a door lock. The key fob or other device can provide the first responder code via wired or wireless communication, such as by plugging the key fob into a reader or other communications interface that communicates the first responder code to the door lock. Such systems can be implemented using RFID tags, card readers or similar communications systems. In other embodiments, the first responder code can be typed, spoken or otherwise entered by first responder personnel, e.g., using a key pad or other user input at the building. The first responder code may be provided in encrypted form, e.g., when communicated electronically via wired or wireless communications, to help reduce a chance that unauthorized people can gain access to or otherwise use the first responder code in an unauthorized way. In some embodiments, the first responder code may be provided for single event or alarm condition use such that the first responder code can only be used during a single, associated alarm condition or a single time. For example, upon an alarm system detecting an emergency condition, the alarm system (e.g., a base station 1 or a monitoring server 8 or lock server 51 which receives notice of an alarm condition from the base station 1) may generate and send a unique first responder code to first responder personnel (e.g., directly to first responder personnel communication devices via a wireless network, and/or via the authorities communication devices 9). When first responder personnel arrive at the building, the personnel may provide the first responder code to the alarm system and/or door lock, e.g., via short range RF communications, manually entering the code into a user interface, displaying the code for optical reading by the alarm system or door lock, etc. After the first responder code generated for the alarm condition is used to gain access, the code may expire and not be usable again for another alarm condition. In some embodiments, the first responder code may expire once the alarm condition that prompted sending of the first responder code is cleared. Thus, the code may be used multiple times during a single emergency condition, but once the alarm condition is cleared, the code may be made invalid. In some embodiments, the first responder code may be valid and usable only once or for a period of time, such as 30 minutes, after an alarm condition is indicated by an alarm system, even if the alarm condition is cleared. After the period of time, the code may be invalid.

The alarm system may detect an emergency condition in a variety of different ways. For example, a base station may receive information from one or more sensors arranged to detect a person's vital signs, and if the information indicates a medical emergency, such as an indication of a pulse rate above or below a particular range, or breathing rate above or below a particular range, or blood pressure above or below a particular range, or other characteristic of a person that indicates a medical emergency, the base station may indicate an alarm condition indicative of a medical emergency. In response, the base station 1 or monitoring server 8 can provide information to authorities communication devices 9, e.g., to summon medical personnel to the building 3, and/or to the lock server 51, which sends a signal to the door lock 2 indicating that a first responder code is usable to gain entry to the building 3. As noted above, a first responder code may be sent to first responder personnel, e.g., from the lock server 51 to the authorities communication devices 9, and/or to the door lock 2 so that the first responder code can be used to cause the door lock 2 to disengage. In other embodiments, an alarm system can detect an emergency condition in response to a signal from a user device that is activated by a person, e.g., the user device may include a panic button and when a user presses the panic button, the user device may send a signal from the user device to the base station indicating an emergency condition. The alarm system may detect an emergency condition in other ways, such as based on information from one or more sensors such as a smoke or fire sensor, and so on. As an example, in the case of a forced entry emergency condition, detection of movement of a locked door from a closed to open position, breakage of door or window glass, movement within the building when the alarm system is in an away or other similar mode, and others, may be used to detect an emergency forced entry condition.

The alarm system may be capable of detecting other alarm conditions in addition to smoke/fire, forced entry and emergency medical conditions, although an alarm state indicated by the alarm system may not enable use of a first responder code to gain access to the building. For example, the alarm system may include one or more sensors to generate a signal representing one or more of the following: detection of movement within the building, detection of opening of a window of the building, detection of sound within the building, detection of breakage of glass at the building, detection of people in or around the building, and/or detection of a low temperature or water at the building. When in an armed state, the base station or other alarm system component may indicate an alarm state based on a signal from the one or more sensors, such as breakage of glass. However, such an alarm state may not enable use of a first responder code to gain access to the building. In some embodiments, a user may set which alarm states can enable use of a first responder code to gain access to a building. For example, certain alarm states may cause the alarm system to notify police or other authorities, such as sensed conditions that indicate a break-in to the building, and for such alarm states, a first responder code may be authorized for use to gain entry to the building. However, other alarm states, such as sensed conditions that indicate water in the building or a low temperature, may not cause the alarm system to notify authorities and so no first responder code is needed. As another example, sensed conditions at the exterior of a building, such as unauthorized movement of people around a building, may cause the alarm system to indicate an alarm state but access to the building interior is not necessary for police or other first responder personnel. In such cases, a first responder code need not be authorized for use.

Each of the components in FIGS. 1 and 2 may be implemented, at least in part, by a suitably programmed computer or other data processor, and may be employed in the form of software modules, ASICs, programmable arrays, or any other suitable arrangement, in addition to hardware components. For example, computer-implemented portions of the base station 2, door lock 2, monitoring server 8, authorities devices 9, lock server 51, etc. may be implemented at least in part as single special purpose integrated circuits (e.g., ASICs), or an array of ASICs, each having a main or central processor section for overall, system-level control and separate sections dedicated to performing various different specific computations, functions and other processes under the control of the central processor section, as a plurality of separate dedicated programmable integrated or other electronic circuits or devices, e.g., hardwired electronic or logic circuits, such as discrete element circuits or programmable logic devices, as a programmed general purpose computer and/or other data processing device along with suitable software or other operating instructions, one or more memories (including non-transient storage media that may store software and/or other operating instructions), and so on. The devices may also include other components, such as an information display device, user input devices (such as a keyboard, user pointing device, touch screen or other user interface), data storage devices, communication devices, a power supply for the control circuitry and/or other system components, temperature and liquid level sensors, pressure sensors, RFID interrogation devices or other machine readable indicia readers (such as those used to read and recognize alphanumeric text, barcodes, security inks, etc.), video recording devices, speakers or other sound emitting devices, input/output interfaces (e.g., such as the user interface to display information to a user and/or receive input from a user), communication buses or other links, a display, switches, relays, triacs, motors, mechanical linkages and/or actuators, or other components necessary to perform desired input/output or other functions.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

The invention claimed is:

1. A method for controlling an alarm system, comprising:
detecting that a door of a building is in a closed position;
receiving a signal that a lock associated with the door is to be engaged so as to lock the door in the closed position;
receiving a signal indicating that the lock cannot be engaged to lock the door in the closed position; and
in response to receiving the signal indicating that the lock cannot be engaged and without a user taking action after the signal indicating that the lock cannot be engaged to arm the alarm system, arming the alarm system to indicate an alarm state upon detection of movement of the door from the closed position to an open position.

2. The method of claim 1, wherein detecting that the door is in the closed position includes using a door sensor to detect that the door is in the closed position.

3. The method of claim 2, wherein the door sensor is separate from the lock associated with the door.

4. The method of claim 1, wherein receiving a signal that a lock associated with the door is to be engaged includes receiving a signal from a user device instructing the lock to move to an engaged position so as to lock the door in the closed position.

5. The method of claim 4, wherein the lock is an automated lock system arranged to be engaged and disengaged with respect to the associated door based on signals provided from the user device.

6. The method of claim 1, wherein receiving a signal indicating that the lock cannot be engaged includes receiving a signal from the lock indicating that a portion of the lock cannot be moved to an engaged position to lock the door in the closed position.

7. The method of claim 6, wherein the portion of the lock is a latch or bolt that is mechanically prevented from moving to the engaged position due to a position of the door relative to a frame of the door.

8. The method of claim 1, wherein arming the alarm system includes putting the alarm system into an away mode in which the alarm system generates an alarm state upon detection of the door moving from the closed position to an open position as well as upon one or more of the following: detection of movement within the building, detection of opening of a window of the building, detection of sound within the building, detection of breakage of glass at the building, detection of fire at the building, detection of people in or around the building, and detection of a low temperature or water at the building.

9. The method of claim 1, wherein arming the alarm system includes putting the alarm system into a home mode in which the alarm system generates an alarm state upon detection of the door moving from the closed position to an open position, but does not generate an alarm condition upon detection of movement within the building.

10. The method of claim 9, wherein the alarm system in the home mode is arranged to generate an alarm state upon detection of one or more of the following: detection of opening of a window of the building, detection of breakage of glass at the building, detection of fire in the building, detection of people around the building, and detection of water at the building.

11. The method of claim 1, wherein in response to receiving the signal indicating that the lock cannot be engaged, sending a message to a user device indicating that the lock cannot be engaged.

12. The method of claim 11, wherein sending a message to a user device includes requesting assistance from the user to engage the lock.

13. The method of claim 1, further comprising receiving at the lock a signal instructing the lock to engage so as to lock the door in the closed position.

14. The method of claim 1, wherein receiving a signal that a lock associated with the door is to be engaged includes receiving a signal from a user device instructing that all doors of the building are to be locked and the alarm armed to indicate an alarm condition in response to a plurality of conditions.

15. An alarm system, comprising:
a door sensor arranged to detect and provide a signal representing whether a door of a building is in an open or closed position;
a door lock associated with the door and arranged to engage to lock the door in the closed position; and
a base station arranged to receive signals from the door sensor representing whether the door is in the open or closed position, and arranged to receive a signal from the door lock indicating whether the door lock is engaged to lock the door in the closed position, the base station configured and arranged to enter an armed state in response to a signal from the door lock indicating that the door lock is unable to engage to lock the door in the closed position and without a user taking action to arm the alarm system after the signal from the door lock indicating that the lock is unable to engage, the armed state being a state in which the base station indicates an alarm state upon detection by the door sensor of the door moving from the closed position to the open position.

16. The system of claim 15, further comprising one or more sensors to generate a signal representing one or more of the following: detection of movement within the building, detection of opening of a window of the building, detection of sound within the building, detection of breakage of glass at the building, detection of fire in the building, detection of people in or around the building, and detection of a low temperature or water at the building; and
wherein the base station is arranged, when in an armed state, to indicate an alarm state based on a signal from the one or more sensors.

17. The system of claim 16, wherein the base station is configured and arranged to enter an away mode in response to the signal from the door lock indicating that the door lock is unable to engage, the away mode being an armed state in which the base station indicates an alarm state upon detection of the door moving from the closed position to an open position as well as upon one or more of the following: detection of movement within the building, detection of opening of a window of the building, detection of sound within the building, detection of breakage of glass at the building, detection of fire in the building, detection of people in or around the building, and detection of a low temperature or water at the building.

18. The system of claim 16, wherein the base station is configured and arranged to enter a home mode in response to the signal from the door lock indicating that the door lock is unable to engage, the home mode being an armed state in which in which the alarm system indicates an alarm condition upon detection of the door moving from the closed position to an open position, but does not generate an alarm condition upon detection of movement within the building.

19. The system of claim 15, wherein the door sensor is separate from the door lock associated with the door.

20. The system of claim 15, wherein the door lock is configured and arranged to receive a signal from a user device instructing the door lock to move to an engaged position so as to lock the door in the closed position, and the door lock is configured and arranged to move a portion of the door lock to the engaged position in response to the signal from the user device.

21. The system of claim 20, wherein the door lock is configured and arranged to send a signal to the base station indicating that a portion of the lock cannot be moved to the engaged position to lock the door in the closed position.

22. The system of claim 21, wherein the portion of the lock is a latch or bolt that is mechanically prevented from moving to the engaged position due to a position of the door relative to a frame of the door.

23. The system of claim 15, wherein the door lock is an automated lock system arranged to be engaged and disengaged with respect to the associated door based on signals provided from a user device.

24. The system of claim 15, wherein the base station is arranged to operate within the building.

25. The system of claim 15, wherein the base station is arranged to communicate with a monitoring server that is remote from the building, the base station arranged to send a signal representing the alarm state to the monitoring server.

26. The system of claim 15, wherein when the base station indicates an alarm state in response to the door moving from the closed position to the open position, the base station enters an entry delay mode during which a user can prevent the base station from notifying authorities of the alarm state.

27. The system of claim 26, wherein the entry delay mode is associated with a period of time, and the base station is configured to notify authorities of the alarm state if the period of time passes and a user does not prevent the base station from notifying authorities.

28. The system of claim 15, wherein the base station is configured and arranged to not enter the armed state in response to a signal from the door lock indicating that the door lock is able to engage to lock the door in the closed position.

29. An alarm system, comprising:

a door sensor arranged to detect and provide a signal representing whether a door of a building is in an open or closed position;

a door lock associated with the door and arranged to engage to lock the door in the closed position; and a controller arranged to receive signals from the door sensor representing whether the door is in the open or closed position, and arranged to receive a signal from the door lock indicating whether the door lock is engaged to lock the door in the closed position, the controller configured and arranged to enter an armed state in response to a signal from the door lock indicating that the door lock is unable to engage to lock the door in the closed position and without a user taking action to cause the controller to enter the armed state after the signal from the door lock indicating that the lock is unable to engage, the armed state being a state in which the controller indicates an alarm state upon detection by the door sensor of the door moving from the closed position to the open position.

* * * * *